US009805681B2

(12) United States Patent
Brown

(10) Patent No.: US 9,805,681 B2
(45) Date of Patent: Oct. 31, 2017

(54) FAST GATE DRIVER CIRCUIT

(71) Applicant: Apple Inc., Cupertino, CA (US)

(72) Inventor: James E. C. Brown, San Jose, CA (US)

(73) Assignee: APPLE INC., Cupertino, CA (US)

( * ) Notice: Subject to any disclaimer, the term of this patent is extended or adjusted under 35 U.S.C. 154(b) by 70 days.

(21) Appl. No.: 14/832,600

(22) Filed: Aug. 21, 2015

(65) Prior Publication Data

US 2016/0267867 A1 Sep. 15, 2016

Related U.S. Application Data

(60) Provisional application No. 62/130,992, filed on Mar. 10, 2015.

(51) Int. Cl.
*G09G 3/36* (2006.01)

(52) U.S. Cl.
CPC ... *G09G 3/3677* (2013.01); *G09G 2310/0291* (2013.01)

(58) Field of Classification Search
CPC combination set(s) only.
See application file for complete search history.

(56) References Cited

U.S. PATENT DOCUMENTS 6,094,095 A * 7/2000 Murray ..... H02M 3/073 327/530
6,262,598 B1 * 7/2001 Cairns ..... G11C 7/062 326/114
8,004,339 B2 * 8/2011 Barrow ..... H03K 19/0008 326/63
2003/0201803 A1 * 10/2003 Kim ..... G11C 7/12 327/108
2009/0046503 A1 * 2/2009 Luk ..... G11C 11/36 365/175
2009/0103382 A1 * 4/2009 Luk ..... G11C 7/067 365/205
2010/0231569 A1 * 9/2010 Shimatani ..... G09G 3/3688 345/211
2012/0127138 A1 * 5/2012 Tsuchi ..... H03F 1/0261 345/204
2015/0042689 A1 2/2015 Kim et al.
2015/0077407 A1 3/2015 Kim et al.
2015/0102990 A1 4/2015 Kuo
2015/0303925 A1 * 10/2015 Qi ..... H03K 19/09429 326/87

* cited by examiner

*Primary Examiner* — Van Chow
(74) *Attorney, Agent, or Firm* — Blakely Sokoloff Taylor & Zafman LLP

(57) ABSTRACT

A gate line driver circuit for a display panel includes a pull up circuit to drive a gate line of a display panel to a positive voltage that causes display panel switch elements that are coupled to the gate line to transition into an on state, a first pull down transistor to drive the gate line to a first negative voltage that causes the coupled display panel switch elements to transition into an off state, and a second pull down transistor to maintain the gate line at a second negative voltage that is less negative than the first negative voltage so as to maintain the coupled display panel switch elements in the off state. Other embodiments are also described and claimed.

20 Claims, 4 Drawing Sheets

FAST GATE DRIVER CIRCUIT

This non-provisional application claims benefit of the earlier filing date of U.S. Provisional Application Ser. No. 62/130,992, filed Mar. 10, 2015.

An embodiment of the invention relates to circuitry for driving the gate lines of a display element array, such as an active matrix liquid crystal display (LCD) panel that also has a metal oxide semiconductor (MOS) thin film transistor (TFT) array. Other embodiments are also described.

BACKGROUND

For many applications, and particularly in consumer electronic devices, the large and heavy cathode ray tube (CRT) has been replaced by flat panel display types such as liquid crystal display (LCD). A flat panel display contains an array of display elements. Each display element is to receive a signal that represents the picture element (pixel) value to be displayed at that location. In an active matrix array, the pixel signal is applied using a pixel transistor that is coupled to and integrated with the display element. The pixel transistor acts as a switch element. It has a carrier electrode that receives the pixel signal and a control electrode that receives a gate (select) signal. The gate signal may serve to turn on or turn off the transistor so as to selectively apply or "sample" the pixel signal onto the coupled display element. In many instance, the pixel transistor is formed as a thin film transistor (TFT) on the display panel as its substrate.

Typically, thousands or millions of copies of the display element and its associated switch element (e.g., an LCD cell and its associated field effect transistor, FET) are reproduced in the form of an array, on a substrate such as a plane of glass or other light transparent material. The array is overlaid with a grid of data lines and gate lines. The data lines serve to deliver the pixel signals to the carrier electrodes of the transistors and the gate lines serve to apply the gate signals to the control electrodes of the transistors. In other words, each of the data lines is coupled to a respective group of display elements, typically referred to as a column of display elements, while each of the gate lines is coupled to a respective row of display elements.

Each data line is coupled to a data line driver circuit that receives control and pixel signals from a signal generator. The latter translates incoming pixel values (for example, red, green and blue pixel values) into data signals (with appropriate timing). The data line driver then performs the needed voltage level shifting to produce a pixel signal with the needed fan-out (current capability).

As to the gate lines, each gate line is coupled to a gate line driver circuit that receives clock (control) signals from the signal generator. These clocks signals, together with a start or input pulse signal are generated into the domain of a reference clock that is received by the signal generator, along with horizontal and vertical sync signals for defining the scan of a each frame. Each gate driver circuit typically drives a respective gate line. The array of display elements are, in most cases, driven in a horizontal or line-by-line scanning fashion: the desired pixel signals for a selected row of display elements are provided on the data lines; and the selected row of display elements is "enabled" by a pulse that is asserted on the associated gate line, by the gate driver circuit of that gate line. The approach is to scan line-by-line or row-by-row in a vertical direction, until the entire display element array has been "filled" with the pixel values of a single image frame.

The gate driver circuitry has stringent requirements in terms of timing of the transitions in the gate signals that it generates (and that are applied to the gate lines). Due to the nature of the display element array where an entire row of display elements are activated essentially simultaneously (within a single gate signal pulse window), and the relatively large number of rows sometimes, the gate driver circuitry needs to provide precise control of the transitions in these gate drive signals. This is also desirable in view of the relatively high refresh rates of, for example, a 100 Hz display panel, in which the entire array of display elements are refreshed 100 times per second.

SUMMARY

It is desirable that the time interval needed for switching off the pixel transistors on a gate line be made smaller, because the sooner the pixel transistors of a given row are turned off, the longer the time interval that is available for performing other needed display tasks, such as settling the data line voltages (pixel signals) for the next frame to be displayed. A faster gate driver circuit is therefore needed, i.e. one that produces a faster turn off phase, for the coupled pixel transistors so that the data line values may be sampled more quickly.

An embodiment of the invention is a gate driver circuit that has a pull up circuit to drive a gate line of a display panel to a positive voltage that causes display panel switch elements that are coupled to the gate line to transition into an on state, a first pull down transistor to drive the gate line to a first negative voltage that causes the coupled display panel switch elements to transition into an off state, and a second pull down transistor to maintain the gate line at a second negative voltage that is less negative than the first negative voltage so as to maintain the coupled display panel switch elements in the off state.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, a given figure may be used to illustrate the features of more than one embodiment of the invention, and not all elements in the figure may be required for a given embodiment.

DETAILED DESCRIPTION

Several embodiments of the invention with reference to the appended drawings are now explained. Whenever aspects of the embodiments described here are not clearly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
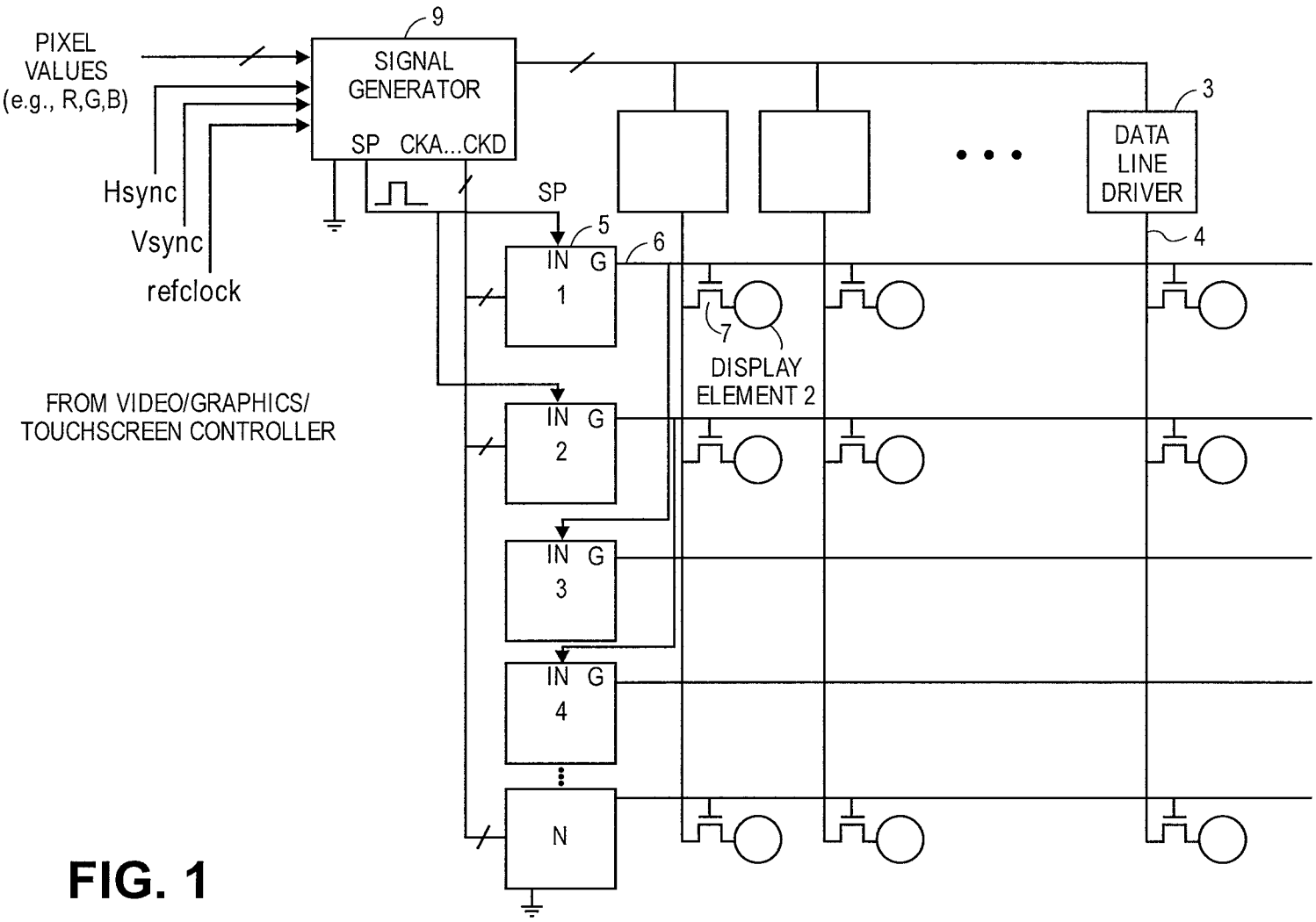
FIG. 1 is a combined block diagram and circuit schematic of an example display element array system.

FIG. 1 is a combined block diagram and circuit schematic of an example display element array system, in which an embodiment of the invention may be implemented. The system has an array of display elements 2. Each display element 2 may be an LCD cell or other suitable type of display cell that serves to display a digital pixel value at a given position of a display panel. A switch element 7 is coupled to each display element. The switch element 7 may be a field effect transistor (FET) as shown, having a gate electrode and upper and lower carrier electrodes (e.g., drain and source electrodes). In this example, the switch element 7 may be a single MOS TFT device (pixel TFT) that is formed on the same substrate as the display element 2. A source of the switch element 7 is coupled to a cell electrode of the display element while its drain is coupled to a data line 4. Each data line 4 is coupled in the same manner to a group of such switch elements 7, in this case forming a column. There are several of such columns as shown. The control electrode (e.g., gate) of the switch element 7 is coupled to a gate line 6. The gate line 6 serves to deliver a display element select or control signal to any one of a group of coupled switch elements 7. Each gate line 6 is coupled in the same manner to a respective group of switch elements 7, in this case forming a row. There are N such rows as shown. With suitable signals being applied to the gate lines and data lines, full control of the color and/or light output characteristics of each cell can be achieved.

The system also has gate line driver circuitry that generates, and is coupled to apply, an output pulse G(i) to each of the N gate lines 6. There is a separate gate line driver 5 (also referred to here as gate driver 5) coupled to drive a respective one of the gate lines 6 as shown. In this example, each gate driver 5 receives at least two clock signals, here, four clocks signals CKA, CKB, CKC, and CKD, which are produced by a signal generator 9. A clock signal is a precision generated digital periodic signal, e.g. binary, 50% duty cycle or square wave, whose transitions may be precisely controlled to be in synch with a reference clock (e.g., refclock). Note that the amplitude of a clock signal may be larger than the swing used by general purpose logic gates, particularly in the case of clock signals applied to drains or sources of the output stage transistors of the gate driver circuit 5 which as explained below may impart a larger amplitude to the output pulse G(i). In one embodiment, each of the clock signals has 50% duty cycle, and their half-period is equal to about twice the duration of a horizontal sync interval H. Other ways of defining the clock signals that are input to the gate driver circuitry are possible.

The gate driver 5 also has a Carrier-In input (In). This input may receive a start pulse (SP, also referred to here as input pulse), when the gate driver 5 is located at the edge of the display element array. Note however that some of the inputs to a particular gate driver 5 may be generated by another gate driver 5; for example, the Carrier-In of the third and any subsequent gate driver 5 is fed by the output pulse G of two rows prior, i.e. G(3) is responsive to G(1) at Carrier-In, G(4) is responsive to G(2) at Carrier-In, G(5) is responsive to G(3), etc. Other ways of triggering the output pulse G(i) of a given gate driver 5 are possible. In one embodiment, the gate drivers 5 are designed such that as a whole they act like a shift register, sequentially generating and applying an output pulse G(i) to each successive gate line 6, when triggered by the start pulse SP.

The clock signals and start pulse SP are produced by a signal generator 9 in response to translating or decoding conventional Hsync and Vsync video display timing signals together with a data enable signal (not shown) that may be received from a video/graphics/touchscreen, vgt, controller (not shown). The signal generator 9 also decodes the incoming pixel values from the vgt controller, into their corresponding voltage or current signals (data signals) for the data line drivers 3, which in turn create the pixel signals to be applied to each display element 2 by its associated switch element 7. The signal generator 9 may use a reference clock (refclock) that may be provided by the vgt controller, to precisely control the timing or signal transitions of the clocks CKA . . . CKD and SP that it produces.

Figure 2:
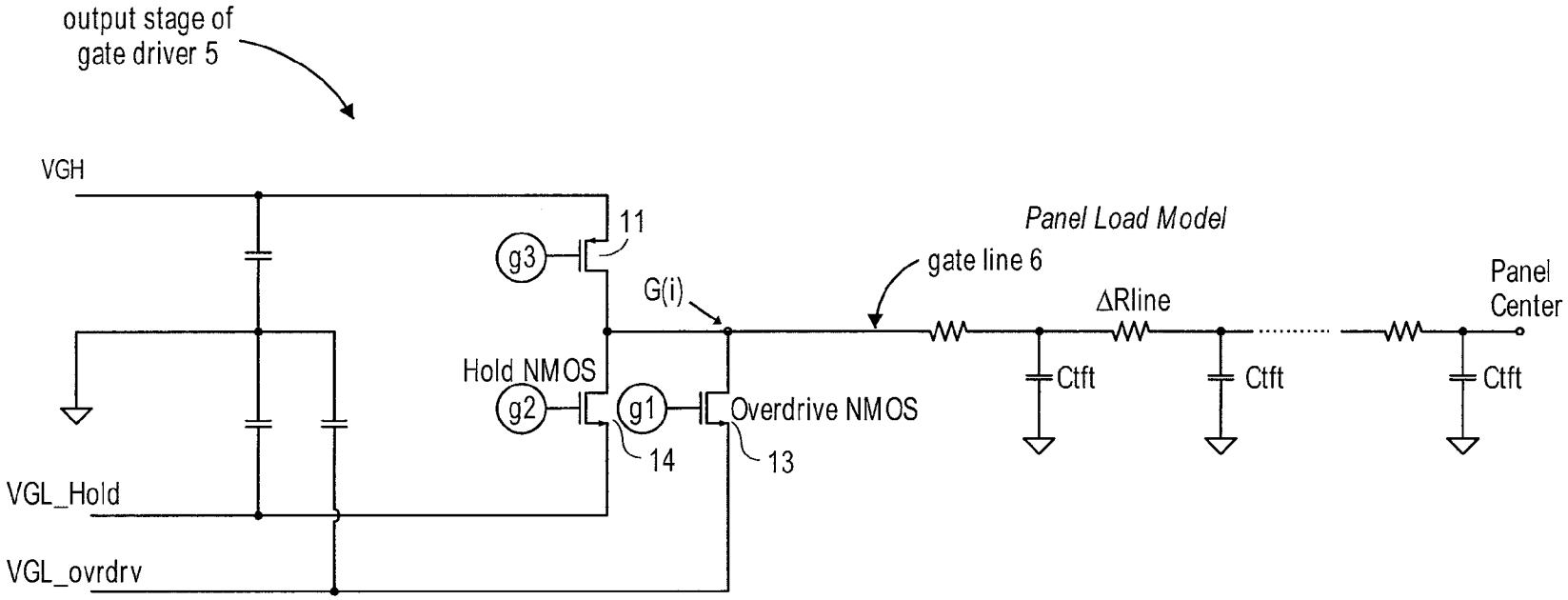
FIG. 2 is circuit schematic of a part of an output stage of a gate driver for a display panel, and a panel load model.

Turning now to FIG. 2, a circuit schematic representing part of a row of a display panel is shown, with particular attention given to an output stage of a gate driver 5 that is in accordance with an embodiment of the invention. The output stage produces the needed gate voltage on the gate line 6, for turning on and then turning off the coupled display elements 7 (e.g., single TFTs) so as to sample the voltages on the data lines 4. In one embodiment, the output stage has a pull up circuit to drive the gate line 6 to a positive voltage VGH, that causes the switch elements that are coupled to the gate line 6 to transition from an off state into an on state. As shown in the example of FIG. 2, the pull up circuit in that case includes a high side transistor (pull up transistor) 11. The transistor 11 in this case is a p-channel MOS (PMOS) FET whose drain is coupled to directly drive the gate line 6. It is operated as a pull-up device in order to raise G(i), the voltage on the gate line 6, to VGH when a control signal g3 is asserted on it gate electrode. Raising the gate line 6 to VGH will cause the coupled switch elements 7 (see FIG. 1) to transition into their on states. Here, +15V is used as an example for VGH, but other voltages are possible so long as they are sufficiently "high" so as to turn on the coupled switch elements 7.

In FIG. 2, the gate line 6 and the switch elements 7 that are coupled to it are represented by a parallel load model of a number of sections, where each section represents the equivalent routing resistance deltaRline between adjacent display elements 2, and the equivalent gate capacitance Ctft of a given switch element 7 (e.g., a MOS TFT). Here, the center of the display panel is indicated as a node whose voltage is of interest and will be used to demonstrate the operation of the output stage. For simulation and demonstration purposes only, this arrangement of the load panel model is for a dual gate driver integrated circuit in which the left half of the panel is driven by a separate gate driver integrated circuit than the right half.

The output stage also includes a pull down circuit, including first low side or pull down transistor 13 to directly drive the gate line to a first negative voltage to cause the coupled display panel switch elements to transition into an off state, and a second low side or pull down transistor 14. In this case, these two transistors 13, 14 are both n-channel MOS (NMOS) FETs whose drains are coupled to the gate line 6. These are operated as pull-down devices. The transistor 13, also labeled as Overdrive NMOS, has its source coupled to VGL_ovrdrv (here, −20V is used as an example, although other voltages are possible as explained below), while the transistor 14, labeled as Hold NMOS, has its source coupled to VGL_hold (here, −12V is used as an example, but other voltages are possible so long as they are sufficiently "low" to maintain the switch element 7 in its turned off state). The Overdrive NMOS (transistor 13) serves to over drive the gate line 6 for a "short" time during pull down, thereby rapidly discharging the control electrodes of the switch elements 7 (e.g., the gate electrodes of the coupled pixel TFTs). This lowers G(i), the voltage on the gate line 6, to a sufficiently low level as to thereby turn off the coupled TFTs. In contrast, the Hold NMOS (transistor 14) serves to directly hold or maintain a less negative (and non-damaging) voltage on the gate line 6, that is less negative than VGL_ovrdrv, after the gate line voltage has transitioned into an "off" range. In one embodiment, the Overdrive NMOS is a larger device than the Hold NMOS (e.g., it has a lower on resistance, Rds_on). That feature, combined with its more negative source line voltage, enables it to sink more current than the Hold NMOS, to thereby discharge the gate line 6 rapidly and force the pixel TFTs to turn off rapidly. An example behavior of the voltage on the gate line 6 during a turn off phase is shown FIG. 3, to illustrate the rapid turn off and then the subsequent hold action of these two NMOS devices.

Figure 3:
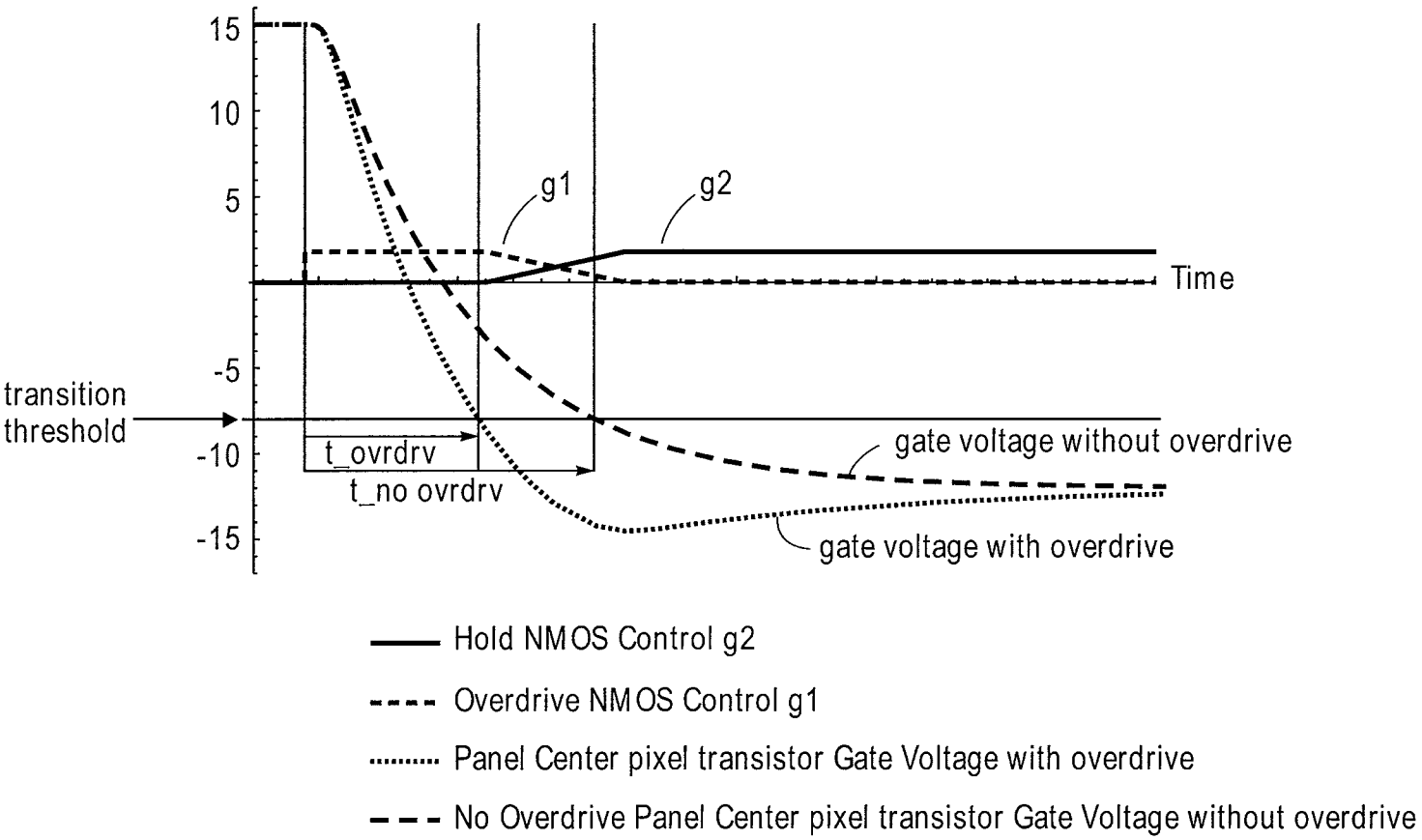
FIG. 3 is a plot vs. time of some example control signals that are applied to the output stage transistors, together with the resulting behavior of the panel center node voltage.

In FIG. 3, a plot vs. time of some example control signals g2, g1 that are applied to the gates of the Hold NMOS and Overdrive NMOS, respectively, are shown, together with the resulting behavior of the panel center node voltage (representing the turn off phase behavior of the gate voltage of a pixel TFT at the middle of the panel). Note here that the Hold NMOS and Overdrive NMOS control waveforms (e.g., g2, g1) are depicted by standard logic levels zero and 2 Volts for purposes of a simulation only, and one of ordinary skill in the art will understand that these may not be the voltage levels that will actually appear on the gate electrodes of the Hold NMOS and Overdrive NMOS devices. The turn off phase in FIG. 3 is depicted for two cases, one with overdrive (using Overdrive NMOS, whose source is coupled to a VGL_ovrdrv of −20V and whose gate is driven by g1) and one with no overdrive (a conventional pull-down NMOS whose source is coupled to a VGL of for example −15V). It can be seen that with the Overdrive NMOS, the pixel center transistor gate voltage reaches the same transition threshold much earlier, thereby resulting in faster turn off. The transition threshold shown in the figure was selected to be the gate voltage that is expected to result in the pixel TFTs being turned off. Once this threshold is reached, control of the gate voltage is handed off to the Hold NMOS, by turning off the Overdrive NMOS (g1 goes from high to low) while simultaneously turning on the Hold NMOS (as shown by the crossing Hold NMOS and Overdrive NMOS control signals in the figure, where g2 goes from low to high). Note that in the overdriven case, the pixel center transistor gate voltage briefly overshoots (becomes more negative than) VGL_hold and then settles back down to VGL_hold. This is due to the Overdrive NMOS being turned on for a "short" or limited interval only, indicated as the assertion of control signal g1 for the duration t_ovrdrv (also shown in FIG. 4). At the end of that interval, there is a transition to the Hold NMOS (depicted by its control voltage g2 rising) which takes over the task of maintaining the gate line 6 at the off voltage (for ensuring that the coupled pixel TFTs remain in their off states), e.g. for the duration of the current display frame. The above description is thus an example of how the signal generator 9 produces a first control signal g1 that drives a control electrode of a first low side transistor (e.g., Overdrive NMOS), and a second control signal g2 that drives a control electrode of a second low side transistor (e.g., hold NMOS), and wherein assertion of the second control signal g2 maintains the respective gate line at a voltage that causes the coupled switch elements (e.g., pixel TFTs) of that gate line 6 to remain in their off states.

Figure 4:
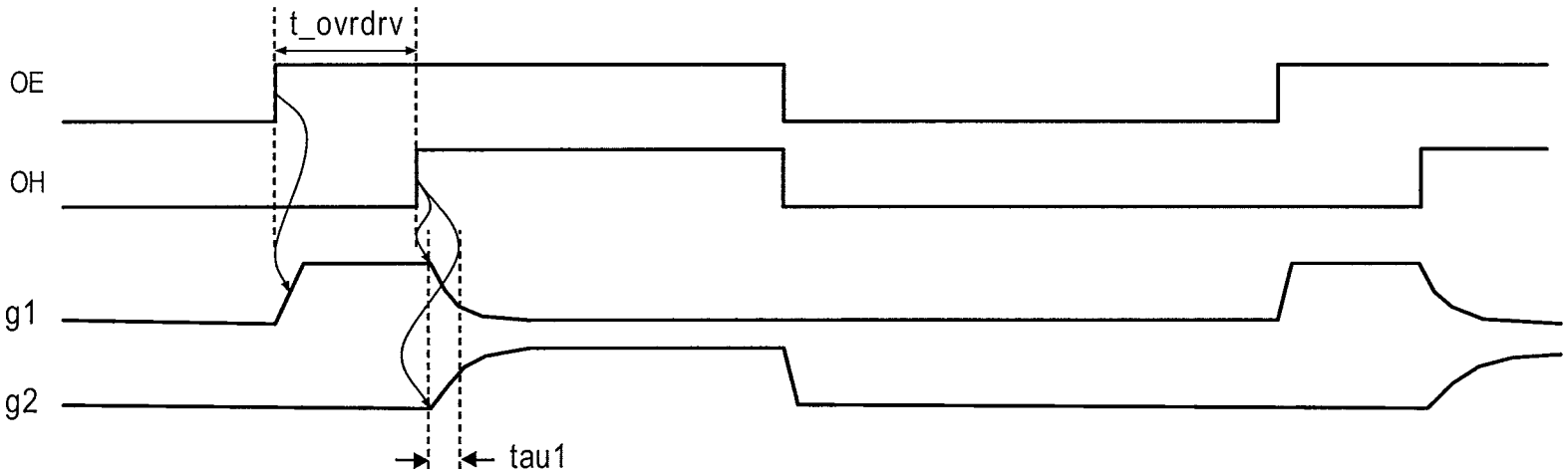
FIG. 4 is another view of some example waveforms involved in producing the control signals that are applied to the output stage transistors.

As seen in FIG. 3 and FIG. 4, the turn-off transition of the respective gate line 6, depicted by the gate line voltage or pixel transistor voltage in FIG. 3 falling in this example from about +15V to about −12V, is accomplished by pulsing the g1 control signal (asserting and then de-asserted for the duration t_overdrv), before asserting the g2 control signal to complete the handoff to the Hold NMOS. It should be noted that in FIG. 3, the hand off from the Overdrive NMOS to the Hold NMOS is gradual (rather than abrupt), as depicted by the smaller angle (gradual, rather than steep) slopes of their respective control signals g1, g2. This is also shown in FIG. 4, as a more detailed view of some example waveforms involved in producing the control signals g1, g2. The control signal g1 is asserted in response to an active edge of an output enable (OE) signal, while the control signal g2 is asserted in response to an active edge of output hold (OH) signal, where the OE and OH signals may be produced by the signal generator 9 (see FIG. 1). The smoother hand off occurring in the interval tau1 may help reduce the likelihood of glitches occurring on the gate line 6 due to transitioning between the different VGL levels, as compared to an abrupt hand off in which the slopes of the control signals are steep. However, the smaller angle slopes should not be so small, or tau1 should not be too long, as to result in both of the transistors, Hold NMOS and Overdrive NMOS, being turned on simultaneously, because that would cause VGL_hold to be short circuited to VGL_ovrdrv. Some overlap in the ending transition of the g1 pulse and the starting transition of the g2 pulse may be allowed, as seen in FIG. 4 and time interval tau1, but is not necessary; the starting transition of g2 may be delayed more than shown, and thus need not overlap the ending transition of g1.

Also, the particular example gate driver output stage in FIG. 2 is for a display panel whose pixel TFTs are rated for operation at a lowest (most negative) gate voltage of for example −16V, where VGL_hold in that case may be set at −12V and VGL_ovrdrv may be set at −20V. More generally, the voltages for the pull up and downs of the output stage may have the relationship VGH>VGL_hold>VGL_ovrdrv where VGL_ovrdrv is more negative than VGL_hold and is more negative than the lowest (most negative) gate voltage for the pixel TFTs. This may require three separate power supply circuits or voltage regulators (not shown, but that may be part of the signal generator 9), to produce VGH and the two VGL voltages. In addition, it should be noted that the VGH and VGL voltage levels that are applied to the sources of the pull up and pull down transistors of the output stage are being switched (according to a raster scan process that updates the pixels in the display panel). Accordingly, additional switching transistors (not shown) are needed to deliver these accurately timed power supply voltages, e.g. as VGH and VGL "clock" signals, in accordance with the correct timing for each row of the display panel. These switching transistors may be part of the signal generator 9. As to the circuitry needed to produce the control signals g1, g2, these may also be a part of the signal generator 9. Note that some portions of the signal generator 9 may be implemented using chip on glass fabrication techniques, as integrated circuitry that is formed directly on a substrate of the display elements 2 (e.g., via a chip on glass fabrication process performed on a glass or other transparent panel in which the display elements 2 are formed in the case of an LCD panel). In particular, in one embodiment, the output stage shown in FIG. 2, including the PMOS, Hold NMOS, and Overdrive NMOS, are formed via chip on glass fabrication directly on the display panel substrate.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the simulation results above were obtained for the circuit in FIG. 2 which depicts a gate driver that is driving one-half of a row of display panel switch elements 7, the gate driver output stages described here can also be used in a single-sided gate driver arrangement that drives an entire row of switch elements 7. The description is thus to be regarded as illustrative instead of limiting.

What is claimed is:

1. A gate line driver circuit for a display panel, comprising:

a pull up circuit to drive a gate line of a display panel to a positive voltage that causes a plurality of display panel switch elements that are coupled to the gate line to transition into an on state;

a first pull down transistor to directly drive the gate line to a first negative voltage that causes the coupled display panel switch elements to transition into an off state; and a second pull down transistor to directly drive and maintain the gate line at a second negative voltage, wherein the first voltage is more negative than the second voltage, and the second voltage maintains the coupled display panel switch elements in the off state.

2. The gate line driver circuit of claim 1 wherein the pull up circuit comprises a PMOS FET, the first pull down transistor is a single NMOS FET, and the second pull down transistor is a single NMOS FET.

3. The gate line driver circuit of claim 2 wherein the single NMOS FET of the first pull down transistor is larger or has lower Rds on than the single NMOS FET of the second pull down transistor.

4. The gate line driver circuit of claim 3 wherein the first negative voltage is more negative than a most negative voltage rating of the display panel switch elements.

5. The gate line driver circuit of claim 1 wherein the first pull down transistor is larger, or has lower Rds_on than the second pull down transistor.

6. The gate line driver circuit of claim 5 wherein the first negative voltage is more negative than a most negative voltage rating of the display panel switch elements.

7. The gate line driver circuit of claim 1 in combination with a signal generator that produces a first pulse on a control electrode of the first pull down transistor, and a second pulse on a control electrode of the second pull down transistor, wherein an ending transition of the first pulse overlaps a starting transition of the second pulse.

8. A display system comprising:

an array of display elements;

a plurality of gate lines coupled to the display elements;

a plurality of switch elements each being coupled to a respective combination of display element and gate line;

a signal generator to produce a positive voltage clock signal, and first and second negative voltage clock signals wherein the first negative voltage clock signal is more negative than the second negative voltage clock signal; and a plurality of gate drivers each being coupled to drive a respective one of the gate lines, each of the gate drivers having an output stage in which there are a high side transistor and first and second low side transistors, wherein the high side transistor is coupled to directly drive the respective gate line responsive to the positive voltage clock signal, and the first and second low side transistors are coupled to directly drive the respective gate line responsive to the first and second negative voltage clock signals.

9. The display system of claim 8 wherein the signal generator produces a first control signal that drives a control electrode of the first low side transistor, and a second control signal that drives a control electrode of the second low side transistor, and wherein for each turn-off transition of the respective gate line, the first control signal is pulsed, or asserted and then de-asserted, before the second control signal is asserted, wherein assertion of the second control signal maintains the respective gate line at a voltage that causes the coupled switch elements to remain in their off states for a duration of a current display frame.

10. The display system of claim 8 wherein the display elements are LCD elements, and the switch elements are TFTs.

11. The display system of claim 10 wherein the output stage is formed directly on a substrate that is part of a display panel in which the display elements are formed.

12. The display system of claim 8 wherein the high side transistor is a PMOS FET, the first low side transistor is a single NMOS FET, and the second low side transistor is a single NMOS FET.

13. The display system of claim 12 wherein the single NMOS FET of the first low side transistor is larger or has lower Rds on than the single NMOS FET of the second low side transistor.

14. The display system of claim 13 wherein the single NMOS FET of the first low side transistor is larger or has lower Rds on than the single NMOS FET of the second low side transistor by a at least a factor of three.

15. The display system of claim 8 wherein the first negative voltage clock signal is more negative than a most negative voltage rating of the switch elements.

16. The display system of claim 8 wherein the first low side transistor is larger, or has a greater Rds_on, than the second low side transistor.

17. A method for driving a gate line of a display panel, comprising:

pulling up a gate line of a display panel to a positive voltage that causes a plurality of display panel switch elements, that are coupled to the gate line, to turn on; then pulling down the gate line to a first negative voltage that causes the switch elements to turn off; and then maintaining the gate line at a second negative voltage, wherein the first voltage is more negative than the second voltage, and the second voltage maintains the switch elements in the off state.

18. The method of claim 17 wherein pulling down the gate line comprises pulsing a first control signal of a control electrode of a first transistor, for a predetermined overdrive time interval.

19. The method of claim 18 wherein maintaining the gate line comprises pulsing a second control signal of a control electrode of a second transistor.

20. The method of claim 19 wherein an ending transition of the first control signal overlaps a starting transition of the second control signal.

* * * * *